US007029160B2

(12) United States Patent
Huang

(10) Patent No.: US 7,029,160 B2
(45) Date of Patent: Apr. 18, 2006

(54) LAMP WEDGE BASE

(76) Inventor: His-Yu Huang, No. 8 Alley 22, Shih-Peng Road, Hsinchu (TW)

( * ) Notice: Subject to any disclaimer, the term of this patent is extended or adjusted under 35 U.S.C. 154(b) by 254 days.

(21) Appl. No.: 10/119,505

(22) Filed: Apr. 9, 2002

(65) Prior Publication Data

US 2004/0198097 A1 Oct. 7, 2004

Related U.S. Application Data

(60) Provisional application No. 60/284,057, filed on Apr. 16, 2001.

(51) Int. Cl.
*H01K 1/00* (2006.01)

(52) U.S. Cl. ..... 362/647; 362/652; 362/659; 439/619; 439/699.2

(58) Field of Classification Search ..... 362/647–659; 439/619, 699.2, 617, 611; 313/318.07, 315, 313/318.09

See application file for complete search history.

(56) References Cited

U.S. PATENT DOCUMENTS 3,945,707 A 3/1976 Fitzgerald
4,603,278 A * 7/1986 Devir et al. ..... 313/318.07
4,647,132 A * 3/1987 Mikola ..... 439/345
4,752,710 A * 6/1988 Devir et al. ..... 313/318.07
4,979,082 A 12/1990 Devir
5,120,233 A * 6/1992 Mikola ..... 439/356
5,278,741 A 1/1994 Ehrman
5,418,698 A 5/1995 Wu
5,669,701 A 9/1997 Lin
5,785,412 A 7/1998 Wu et al.
6,056,417 A * 5/2000 Cheng ..... 362/645
6,464,539 B1 * 10/2002 Yoshida et al. ..... 439/619

* cited by examiner

*Primary Examiner*—Thomas M. Sember
(74) *Attorney, Agent, or Firm*—Paul M. Denk

(57) ABSTRACT

A wedge base for a lamp including a body section for mounting the lamp envelope with filament lead wires extending out, the body having a shoulder and an integral, depending rib. The bottom edge of the rib has notches formed along the lower edge. Lead wire bores are formed through the shoulder and rib and terminate in the notches. The lead wires extend through the bores, out of the notches and are folded upwardly against the rib. A bracket secures the lead wires against the rib. The bracket has a first side with at least one pin and a second side with at least one hole. Each bracket side has vertical wire grooves its inner face. The bracket sides are laterally positioned on each side of the rib with the pin engaging the hole and snapped together to secure the lead wires within the groves and against the rib. When assembled, the base is configured to fit securely, with electrical contact, within the socket of a lamp fixture.

14 Claims, 6 Drawing Sheets

LAMP WEDGE BASE

CROSS-REFERENCE TO RELATED APPLICATIONS

This application claims the benefit of provisional application 60/284,057, filed Apr. 16, 2001.

STATEMENT REGARDING FEDERALLY SPONSORED RESEARCH

Not applicable

BACKGROUND OF THE INVENTION

The invention relates generally to lamps and, more particularly, to wedge base lamps and lamp bases for engagement and improved electrical contact in a fixture having a push-in type socket.

Lamps and lamp fixtures having push-in type sockets are well known to the art. For example, U.S. Pat. No. 4,752,710, to Devir et al, provides an electric lamp with an insulating base providing improved wire retention. U.S. Pat. No. 4,603,278, also to Devir et al discloses an electric lamp with an insulating base. U.S. Pat. No. 6,056,417 provides a two-part wedge base for a lamp. In electric lamps of this type a press seal is formed near the base bulb with the lead wires filament extending out of the envelope to through the base to make electrical connection with electrical contacts within the socket of the fixture. Generally, the lead wires are bent back onto the base and positioned for optimum electrical contact.

It is important to accurately fix the wires at the base so that they align with the contacts within the socket when the bulb is inserted into the socket. Several prior art expedients are known to provide a base which secures and locates the lead wires, including those disclosed in the patents cited above. Often these prior expedients require multipiece bases that must be assembled and glued together. In other instances, such as U.S. Pat. No. 6,056,417, the parts of the base are sonically welded (col. 3, lines 46–50) which requires costly sonic welding equipment. However, it would be advantageous to provide a wedge base that can be snapped together to secure the lead wires or otherwise easily assembled. It also would be advantageous to have a base that can be used to secure the wires and provide an appropriately configured base to fit into the socket for envelopes that do not employ a press seal.

SUMMARY OF THE INVENTION

It is among the several objects of the present invention to provide a wedge base for a lamp that is easily assembled, without glue, to secure the filament lead wires in appropriate positions to make electrical contact with the contacts within a socket.

In general, the present invention includes a center body section having four bores formed through it for the insertion of the filament lead wires that extend out of the envelope. The body section includes a shoulder and a substantially flat, integral depending rib. The shoulder can have an upper annular collar to seat the annular bottom of the envelope. The bottom edge of the rib has notches formed along the lower edge, one notch for each filament lead wire. Each bore extends through the shoulder and rib and terminates in one of the notches. The lead wires exit the open end of the bore and fold upwardly against the rib. The notches are positioned to align the lead wires with contacts within the socket.

The wedge also includes a bracket for securing the lead wires against the rib. The bracket includes a first bracket element positioned on one side of the rib and a second or complementary bracket element positioned on the opposite side of the rib. In one embodiment, the inner surface of first side bracket element has three evenly spaced apart, horizontally aligned protrusions or pins thereon. The two end pins are positioned adjacent opposite ends of the rib. The middle pin protrudes through a hole formed through the rib. The second bracket element is aligned with the first bracket element and includes three evenly spaced apart, horizontally aligned holes. The bracket is attached to the rib by inserting the bracket pins in the bracket holes and snapping it together. The bracket elements can have any desired arrangement of pins and holes. The bracket then secures the lead wires in place against the rib. When assembled, the base is configured to fit securely, with electrical contact, within the socket of a lamp fixture.

Other objects of the invention will be apparent to those skilled in the art upon review of the specification and accompanying drawings.

BRIEF DESCRIPTION OF THE DRAWINGS

Corresponding reference numerals indicate corresponding structures throughout the various drawings.

DESCRIPTION OF THE PREFERRED EMBODIMENT

Figure 2:
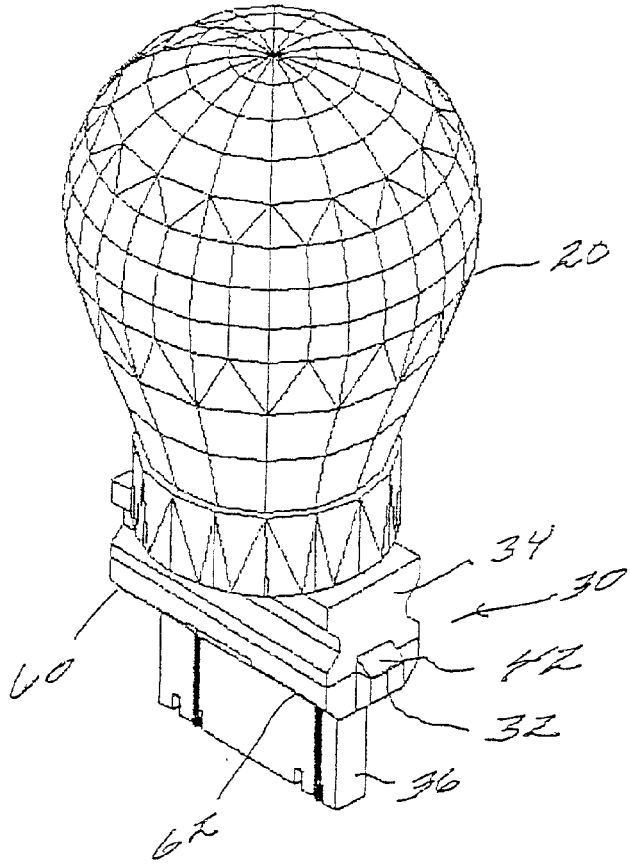
FIG. 2 is an enlarged, assembled view of the lamp assembly of FIG. 1, with the lead wires in their useful position.
Figure 1:
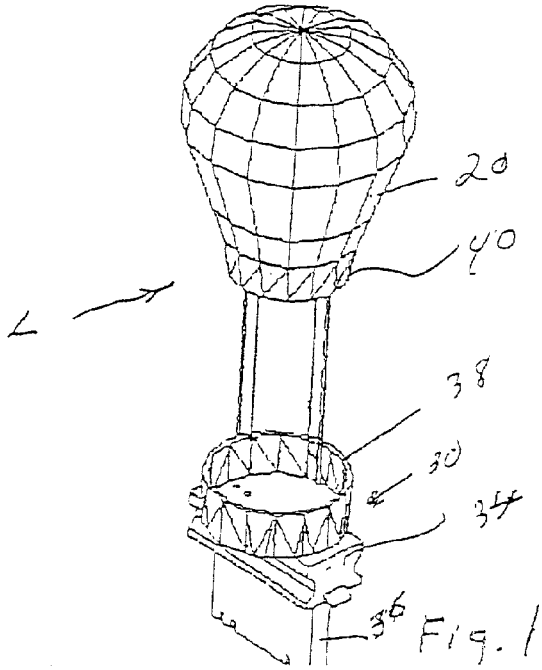
FIG. 1 is a partially exploded view of a lamp assembly employing the novel base of the present invention, without the bracket.
Figure 3:
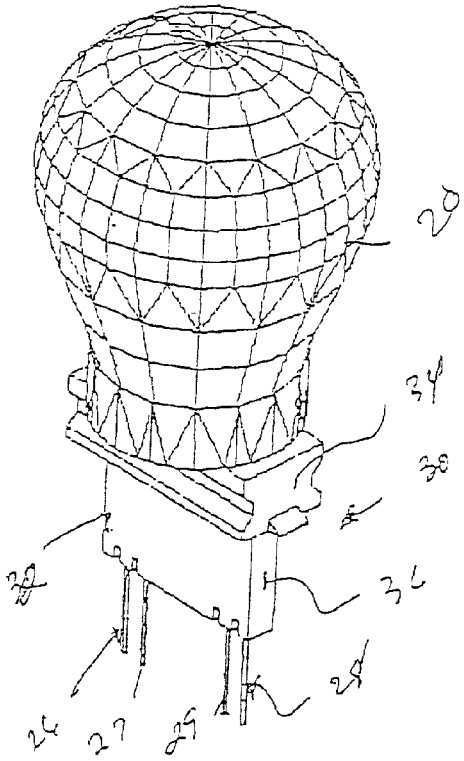
FIG. 3 is an enlarged, assembled view of the lamp assembly of FIG. 1, without the bracket, with the lead wires positioned before bending into their useful position.
Figure 4:
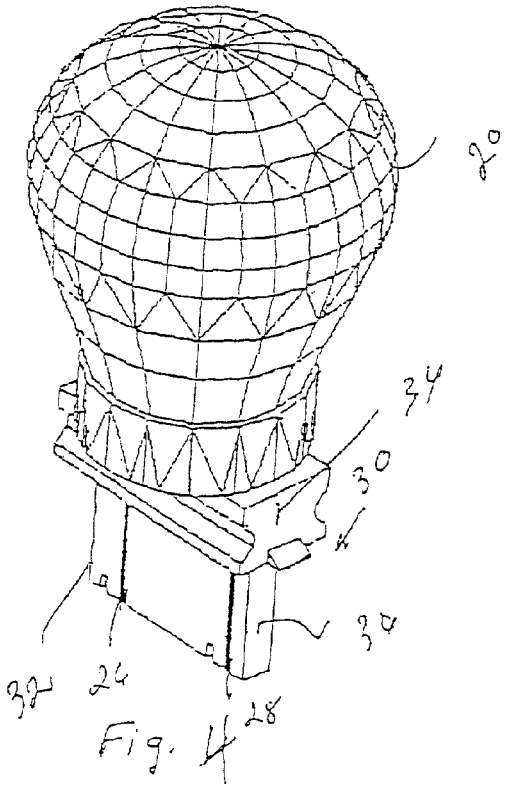
FIG. 4 is an enlarged, assembled view of the lamp assembly of FIG. 3, without the bracket, with the lead wires in their useful position.

A lamp assembly including the novel base of the present invention is indicated by reference numeral L throughout the various drawings. The lamp assembly L includes a generally spherical envelope 20 which encloses first and second filaments 22, 24. The filaments 22 and 24 each include a pair of lead wires 26, 27, and 28 , 29 respectively, which extend out of the envelope to make electrical contact with a socket, as will be explained below.

The lamp assembly L includes a base, indicated generally by numeral 30. The base 30, which is shown in greater detail in FIGS. 9–12 has an integral body section 32. The body section 32 has an upper shoulder 34 and a depending rib 36. In the illustrated embodiment, the shoulder 34 includes an annular collar 38 to seat the annular bottom 40 of the envelope 20. The envelope 20 can be fitted within the collar with a tight friction fit or by adhesive or other appropriate means. It will be noted that the cross-section or specific configuration of the shoulder 34 or positioning of detents, for example detent 42, depends upon the shape or configuration of the envelope or the socket (not shown) into which the base 30 will be plugged, and the specific cross-sectional configuration shown does not form an essential element of the claimed invention.

Figure 5:
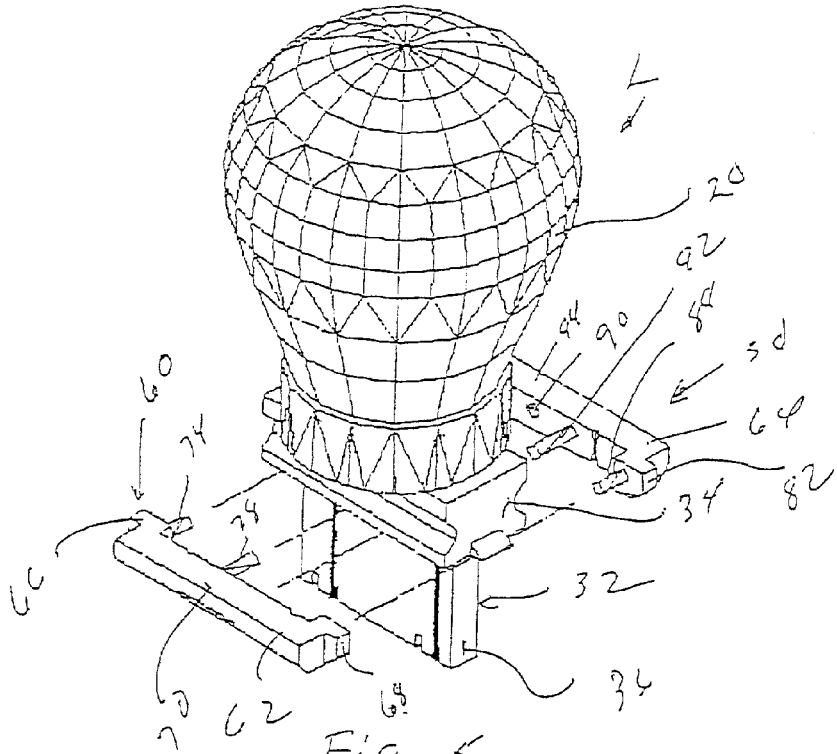
FIG. 5 is an enlarged partially exploded view of a lamp assembly employing the novel base of the present invention, with the bracket in position for assembly.
Figure 6:
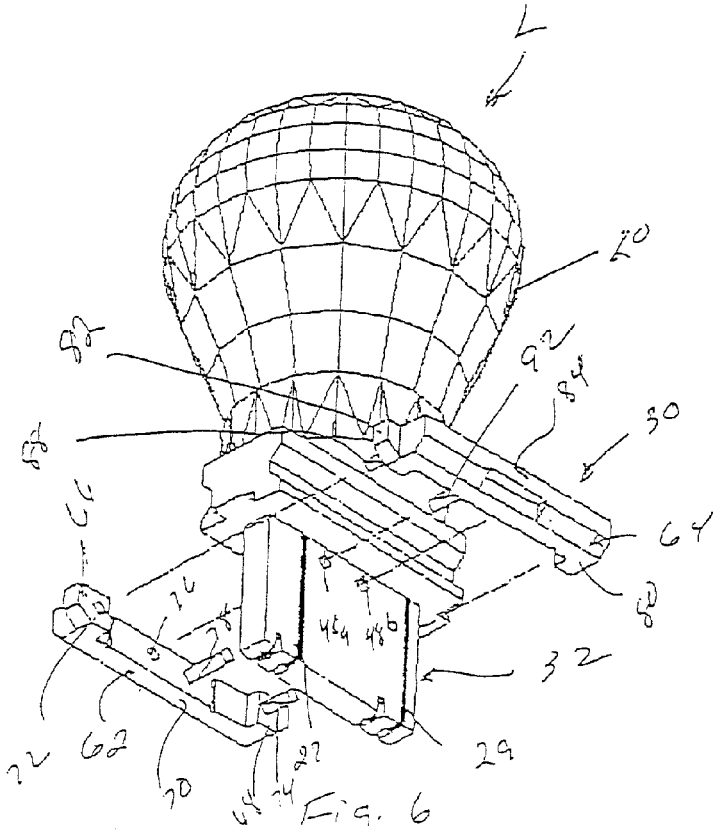
FIG. 6 is an enlarged partially exploded view of a lamp assembly of FIG. 5 from the opposite side.
Figure 7:
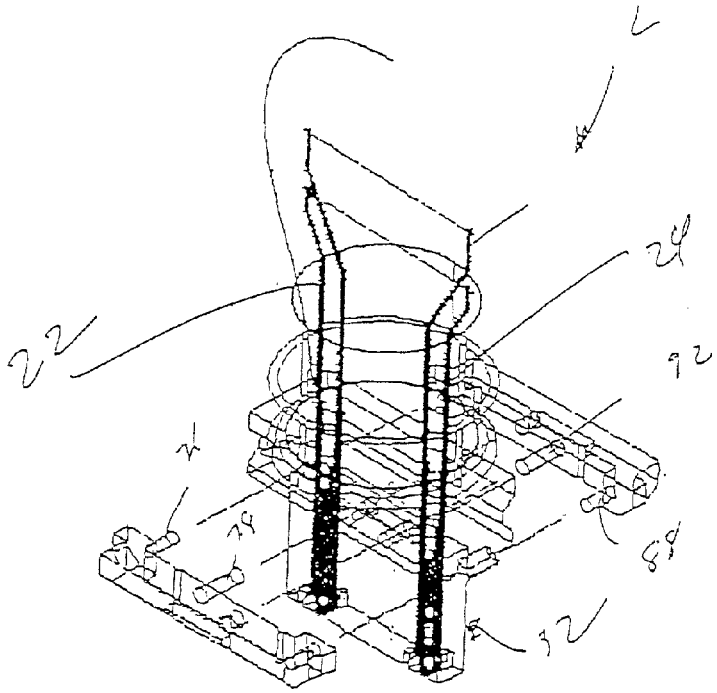
FIG. 7 is an enlarged partially exploded, partially schematic view of a lamp assembly employing the novel base of the present invention, with the bracket in position for assembly, illustrating the positioning of the filament lead wires.
Figure 9:
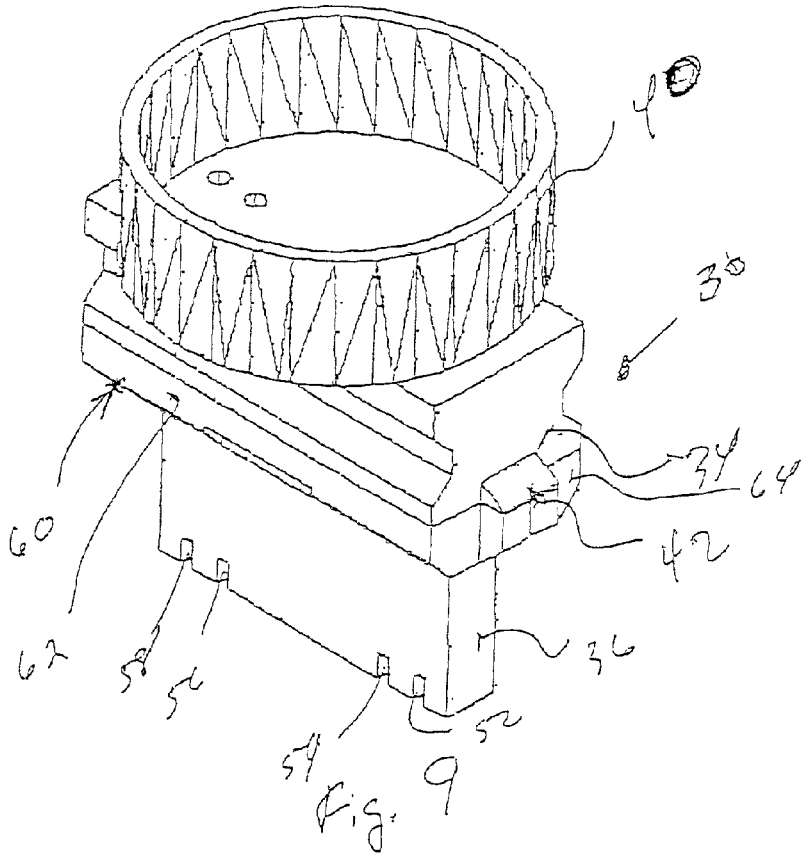
FIG. 9 is an enlarged perspective view of the body section of the novel base of the present invention, with an annular collar on the shoulder segment.
Figure 10:
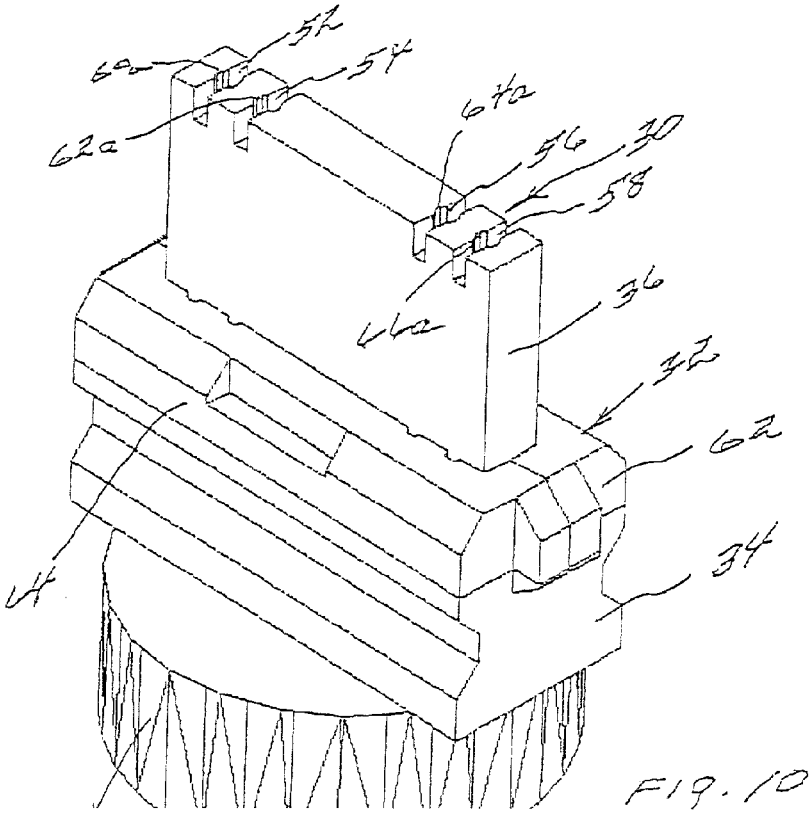
FIG. 10 is an enlarged perspective view of the body section of the novel base of the present invention with an annular collar on the shoulder segment, shown upside down to better illustrate the configuration of the rib segment.
Figure 11:
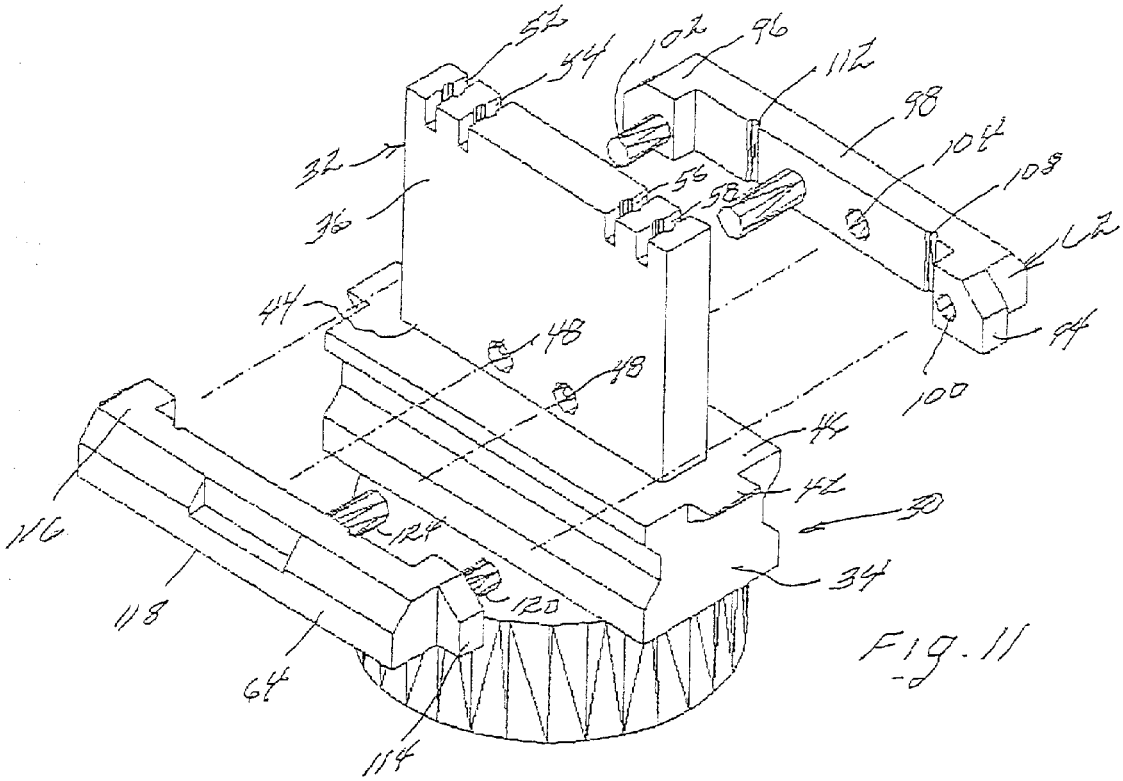
FIG. 11 is an enlarged perspective view of the body section of the novel base of the present invention, with an annular collar on the shoulder segment, shown upside down to better illustrate the configuration of the rib segment, with the bracket in position for assembly.

Depending rib 36 is best in FIGS. 10 and 11. Rib 36 is generally rectangular, relatively flat, having its upper edge 44 attached to or integral with the bottom side 46 of the shoulder. It will be appreciated that the rib 36 is positioned at the horizontal center line of the bottom side 46 of the shoulder. Rib 36 has a holes 48 formed through it adjacent the bottom side of the shoulder in the embodiment shown in FIGS. 10 and 11, and two holes 48*a*, 48*b* formed through it in the embodiment shown in FIG. 6. The rib 36 has four notches 52, 54, 56 and 58 along its bottom edge. Referring to FIGS. 9 and 10, it will be noted that the base 30, specifically the shoulder and the rib, have four (4) bores 60*a*, 62*a*, 64*a*, and 66*a* formed all the way through so that the pairs of lead wires 26, 27, 28 and 29 can extend through the base and out of the rib at the notches 52–58. The lead wires are bent upwardly along opposite sides of the ribs, as shown in FIGS. 5 and 6, for example. The notches 52–58 are position along the edge of the rib so that the upwardly bent leads are in the correct position so as to align with and make electrical contact with contacts within the socket (not shown) when the base 30 is inserted in the socket.

Figure 8:
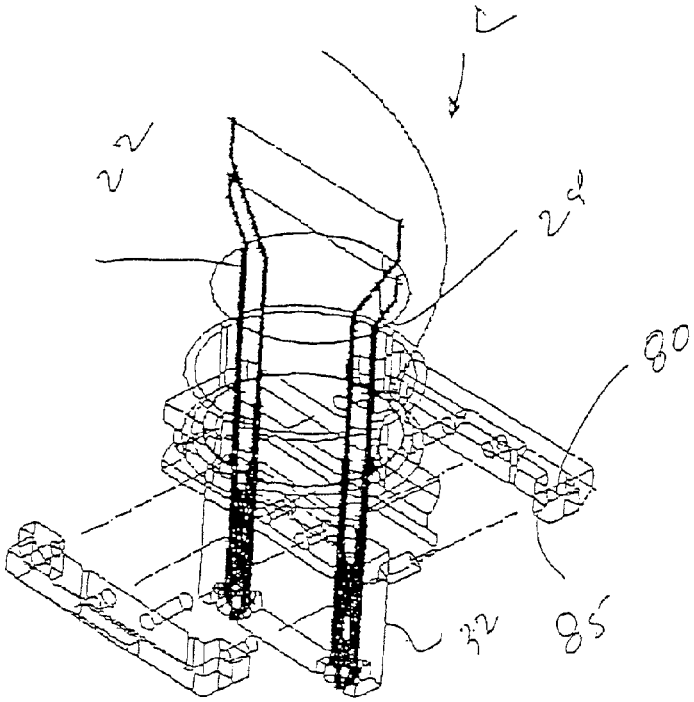
FIG. 8 is an enlarged partially exploded, partially schematic view of a lamp assembly of FIG. 7 from the opposite side.

The lead wires 26–29 are retained in their useful position on the rib by the novel snap fit bracket 60, that will now be described. As shown in the drawings, the bracket 60 includes a first side 62 and a complementary second side 64. The bracket 60 is illustrated in two embodiments, one embodiment shown in greater detail in FIGS. 5 and 6 and the second embodiment shown in greater detail in FIGS. 11 and 12. The two embodiments function the same and include only minor differences. Turning to the embodiment shown in FIGS. 5 and 6, first side 62 includes opposed end flanges 66 and 68 connected a horizontal body section 70. End flange 66 has a centrally placed hole 72. End flange 68 has a centrally placed pin 74. The horizontal body section 70 includes a second hole 76 and a second pin 78. Correspondingly, second side 64 includes opposed end flanges 80 and 82 connected a horizontal body section 84. End flange 80 has a centrally placed hole 85 (FIG. 8). End flange 82 has a centrally placed pin 88. The horizontal body section 84 includes a second hole 90 and a second pin 92. It will be noted this embodiment requires rib 36 to have two holes 48*a* and 48*b*. For assembly the filament lead wires are position on the rib, as show in FIGS. 5 and 6. The two bracket sides are positioned on each side of the rib. The pins 78 and 92 are positioned the holes 48*a* and 48*b* of the rib.

The sides are squeezed together so that pin 88 seats in hole 72, pin 74 seats in the hole in flange 80 and pin 78 seats in hole 90 and pin 92 seats in hole 76 in a tight, snap fit. The complementary flanges are positioned around the ends of the rib. Thus the bracket 60 secures the lead wires in proper position for making electrical contact and also results in the base 32 having an appropriate configuration to fit into the socket (not shown).

Figure 12:
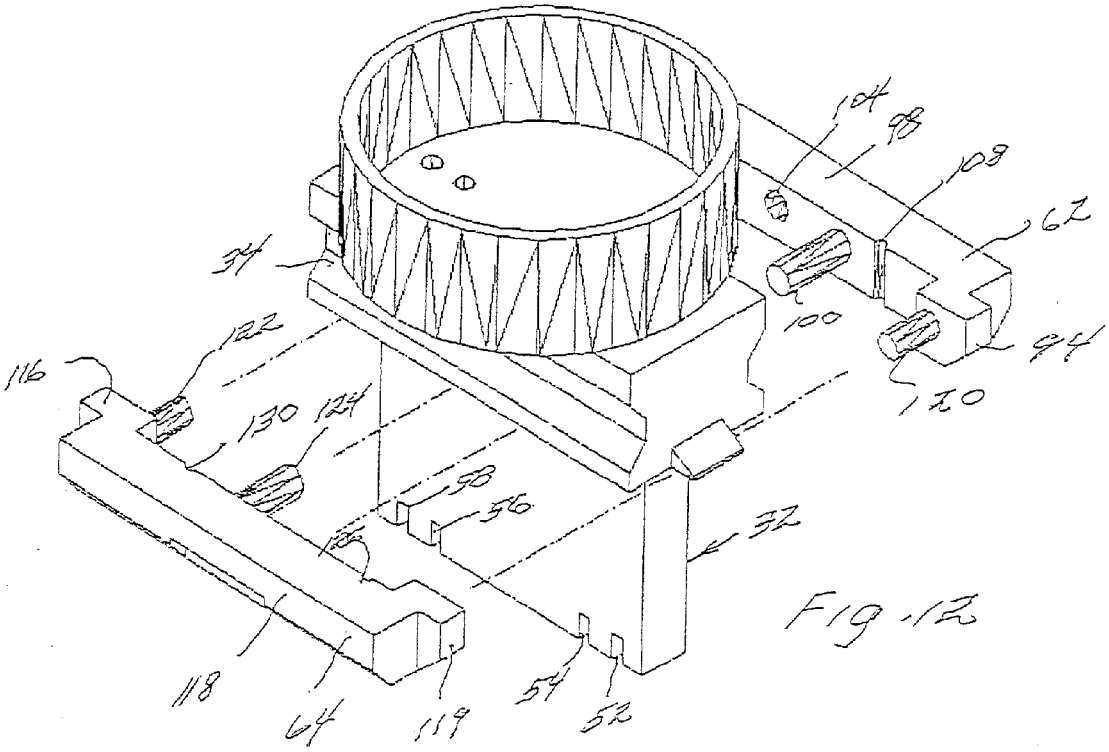
FIG. 12 is another enlarged perspective view of the body section of the novel base of the present invention, with the bracket in position for assembly.

The embodiment of the bracket shown in FIGS. 11 and 12 function similarly to the bracket shown in FIGS. 5 and 6. First side 62 includes opposed end flanges 94 and 96 connected by horizontal body section 98. End flanges 94 and 96 include hole 100 and pin 102, respectively. Body section 98 has a centrally positioned hole 104. It will be noted that the inner face of body section 98 include two vertical grooves 108, and 112. These grooves are position to accommodate the contiguous filament lead wires and secure them in their useful position when the bracket is fully assembled. It should be pointed out that the embodiment of the bracket shown in FIGS. 5 and 6 also include such grooves, but are not as well illustrated in those drawings.

Second side 64 includes opposed end flanges 114 and 116 connected by horizontal body section 118. End flanges 114 and 116 includes a pin 120 and a hole 122, respectively. Body section 118 has a centrally positioned pin 124. It will be noted that the inner face of body section 118 includes two vertical grooves 126 and 130 for securing the lead wires on that side of the rib. Again, for assembly, the two bracket sides are positioned on each side of the rib. Pin 124 is positioned through hole 48 in the rib and the sides are squeezed together until the recited pins of side 64 are snap-fit and secured in the recited complementary holes of side 62. The lead wires nest in the grooves 108, 112, 126 and 130 to prevent lateral movement of the wires upon insertion of the light into a socket.

It will be appreciated that the novel construction of the base of the present invention allows easy assembly without the use of glues, adhesives or welding and results in an operable base which secures the filament lead wires in proper position for making electrical contact. Various changes and modifications may be made in the present invention without departing from the scope of the appended claims. Therefore, the foregoing description and accompanying drawings are intended to be illustrative only, and should not be construed in a limiting sense.

What is claimed is:

1. A wedge base for a lamp that has an envelope, at least one filament within the envelope with filament lead wires extending from within the envelope, comprising:

a body for mounting the envelope, said body including a shoulder and a depending rib, said body having at least one bore formed therethrough, said filament lead wires extending through said at least one bore and each lead wire having a free end positioned in an operational position along an external surface of the rib; and a wire securing bracket for securing the free end of the lead wires in said operational position along the external surface of the rib, said bracket having a first side for positioning on a first side of the rib, said first side including at least one pin thereon and a second side for positioning on a second side of said rib, said second side having at least one hole formed therein, said hole positioned to receive said at least one pin in a tight fit when said bracket is assembled laterally onto the rib whereby the first and second bracket sides are laterally secured together around said rib to secure the free ends of the lead wires in said operation position.

2. The wedge base for a lamp wherein said first bracket side includes at least two pins.

3. The wedge base for a lamp of claim 2 wherein said second bracket side has at least two holes formed therein.

4. The wedge base for a lamp of claim 1 wherein said first bracket side includes at least one hole formed therein.

5. The wedge base for a lamp of claim 4 wherein said second bracket side includes at least one hole formed therein.

6. The wedge base for a lamp of claim 1 wherein said shoulder includes an annular collar for seating the envelope.

7. The wedge base for a lamp of claim 1 wherein an inner surface of said first side bracket has at least one wire seating groove formed therein.

8. The wedge base for a lamp of claim 1 wherein an inner surface of said second side bracket has at least one wire seating groove formed therein.

9. The wedge base for a lamp of claim 1 wherein said rib has at least one pin hole formed therein.

10. The wedge base for a lamp of claim 1 wherein said rib further comprises a bottom edge, said bottom edge having at least one notch formed therein, said notch positioned on said bottom edge where the at least one bore formed through the body terminates in an opening out of the body.

11. The wedge base for a lamp of claim 1 wherein said rib at its bottom edge has at least one groove provided thereacross and wherein at least one lead wire can locate therein during assembly of the lamp.

12. The wedge base for a lamp of claim 11 wherein said rib at its bottom edge having a pair of grooves formed thereacross, and the lead wires extending down from the lamp dispose for locating within said grooves.

13. The wedge base for a lamp of claim 1 and farther comprising a first bracket side including at least two pins, the second bracket side having at least two pins, each said first and second bracket sides having two holes formed therein, said rib having at least a pair of pin holes formed therein, whereby when said first and second bracket sides are brought together, at least one of their pins locate through a pin hole in the rib, and each pin of each bracket side locating within the aligned holes of the other bracket to laterally clamp said bracket about said rib of the wedge base.

14. The wedge base for a lamp of claim 13 wherein said pins frictionally fit within the aligned holes of the opposing bracket side.

* * * * *